US006367274B1

(12) United States Patent
Mellado

(10) Patent No.: US 6,367,274 B1
(45) Date of Patent: Apr. 9, 2002

(54) CABINET FOR DISPLAYING AND CONSERVING OF FOODSTUFFS

(76) Inventor: Antonio Criado Mellado, Parque Technológico de Andalucía—Severo Ochoa, 43, Campanillas (Málaga) (ES), 29590

( * ) Notice: Subject to any disclaimer, the term of this patent is extended or adjusted under 35 U.S.C. 154(b) by 0 days.

(21) Appl. No.: 09/439,216

(22) Filed: Nov. 12, 1999

(30) Foreign Application Priority Data

Nov. 13, 1998 (ES) ..... 9802868 U

(51) Int. Cl.[7] ..... A47F 3/04
(52) U.S. Cl. ..... 62/256; 62/255; 62/258
(58) Field of Search ..... 62/255, 256, 258

(56) References Cited

U.S. PATENT DOCUMENTS 3,129,567 A * 4/1964 Beckwith ..... 62/256
4,777,806 A * 10/1988 Perez ..... 62/256
5,357,767 A * 10/1994 Roberts ..... 62/256
5,477,702 A * 12/1995 Kenedy et al. ..... 62/256
5,592,059 A * 1/1997 Archer ..... 62/215

* cited by examiner

*Primary Examiner*—William E. Tapolcai
*Assistant Examiner*—Mohammad M Ali
(74) *Attorney, Agent, or Firm*—Klauber & Jackson

(57) ABSTRACT

Cabinet permits self-service by persons who are going to eat and has a counter or top (2) on which the foodstuffs are situated, having optionally means for conserving the foodstuffs in a hot and/or cold state. Its fundamental innovation lies in that it has means (3, 4 and 5) for applying a continuous air curtain (6) over said foodstuffs without impeding access to the same and for the purpose of preventing the presence of insects on the foodstuffs mentioned.

18 Claims, 2 Drawing Sheets

CABINET FOR DISPLAYING AND CONSERVING OF FOODSTUFFS

OBJECT OF THE INVENTION

The present invention, according to that stated in the title piece to this description, concerns an improved cabinet for the display and conservation of foodstuffs, the purpose of which is to prevent insects landing on the dishes on display without having to cover or occult said dishes and without preventing the users or diners from having access to them, whereby excellent conditions of hygiene, appearance and functionality are provided for the display of the foodstuffs in question.

DESCRIPTION OF THE INVENTION

To achieve the objectives indicated here above, the invention consists of an improved cabinet for displaying and conserving foodstuffs which offers the fundamental innovation of incorporating a continuous curtain of air applied over the foodstuffs displayed, so that these are kept free from insects without access to them being impeded on the part of the users.

The air curtain referred to can be applied over dishes that are hot, cold and of any kind, and it is of special use in dining rooms where there is no air conditioning or which are out of doors.

The air curtain is driven by means of a medium or high pressure blower, which is housed in one of the cabinet uprights of the cabinet, or it can be located remotely at a certain distance. The outflow from said blower can be regulated by means of an electronic frequency control or mechanically by means of valves.

A single cabinet can incorporate one or more of these air curtain systems, depending on the cabinet length.

The counter for display and conservation of foodstuffs of the cabinet in question has a centrally located general air supply collector with a dust particle filter which is elevated to a certain height above said counter.

This collector has on the upper side horizontal arms, preferentially two in number, which feed into baffles that permit changes to be made in the direction of the air towards the counter or top on which the foodstuffs are located.

On the horizontal arms of the collector is mounted a lighting panel on which, in turn, is placed a transparent shelf of glass or methacrylate with curved edges. Externally the cabinet of the invention can be decorated in any manner.

The configuration described can be varied in accordance with different examples of embodiment.

Among the benefits of the cabinet of the invention can be highlighted the provision of absolute hygiene, through the prevention of insects reaching the foodstuffs and consequently the avoidance of contamination of the latter; thus, the disagreeable presence of flies, mosquitoes and the like on the foodstuffs is avoided. In addition, the cost is eliminated of requiring employees positioned permanently at different parts of the cabinet in order to chase away the insects, which is disagreeable manner to see and produces alterations in the temperatures of the foodstuffs.

Here below, for the purpose of assisting in a better understanding of this description and forming an integral part thereof, is attached a number of drawings in which, by way of illustration and without being limiting in nature, the object of the invention is presented.

DESCRIPTION OF AN EXAMPLE OF EMBODIMENT OF THE INVENTION

Figure 1:
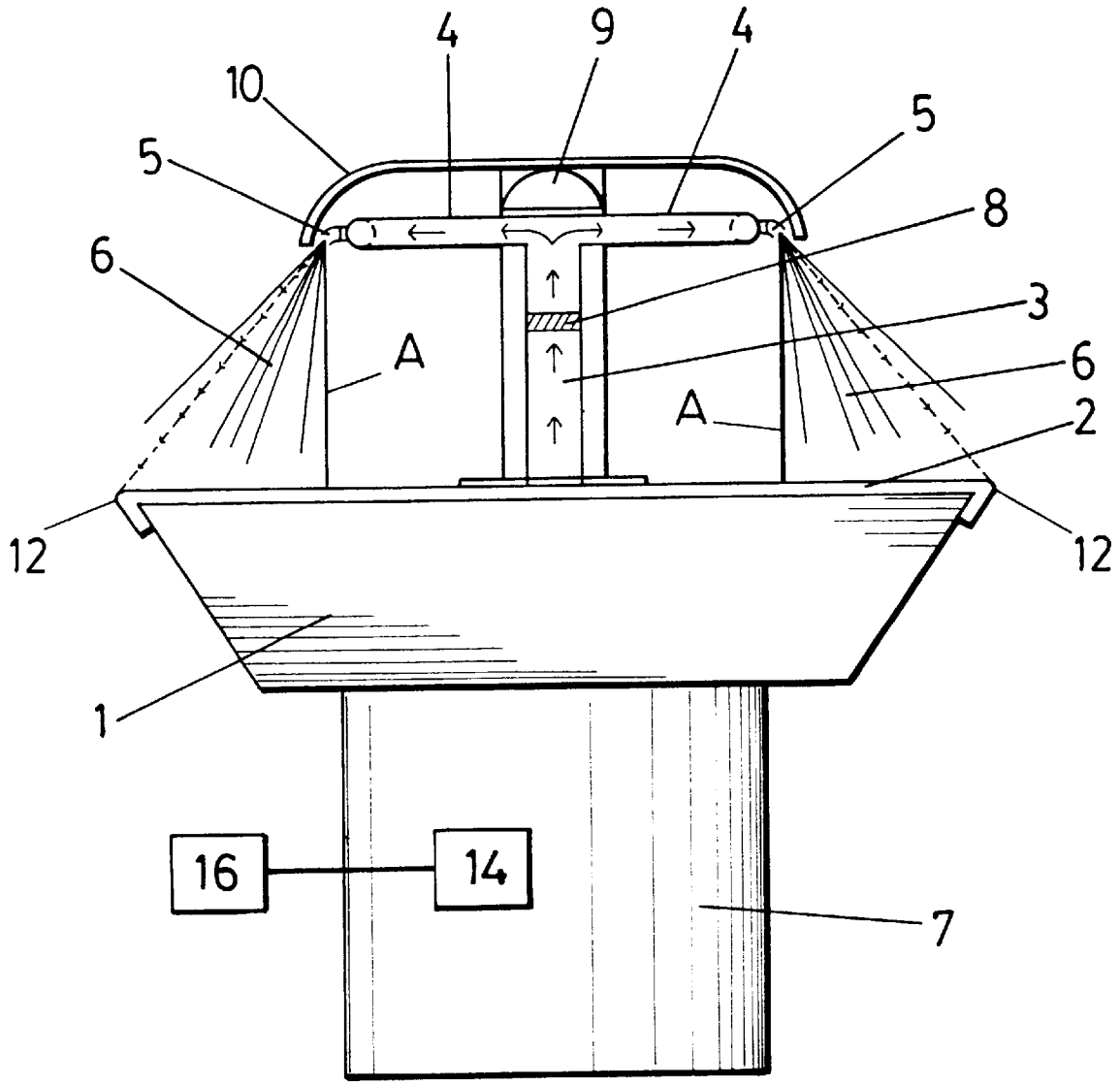
FIG. 1.—Shows a schematic sectional view in profile of an improved cabinet for displaying and conserving foodstuffs, implemented according to the present invention.
Figure 2:
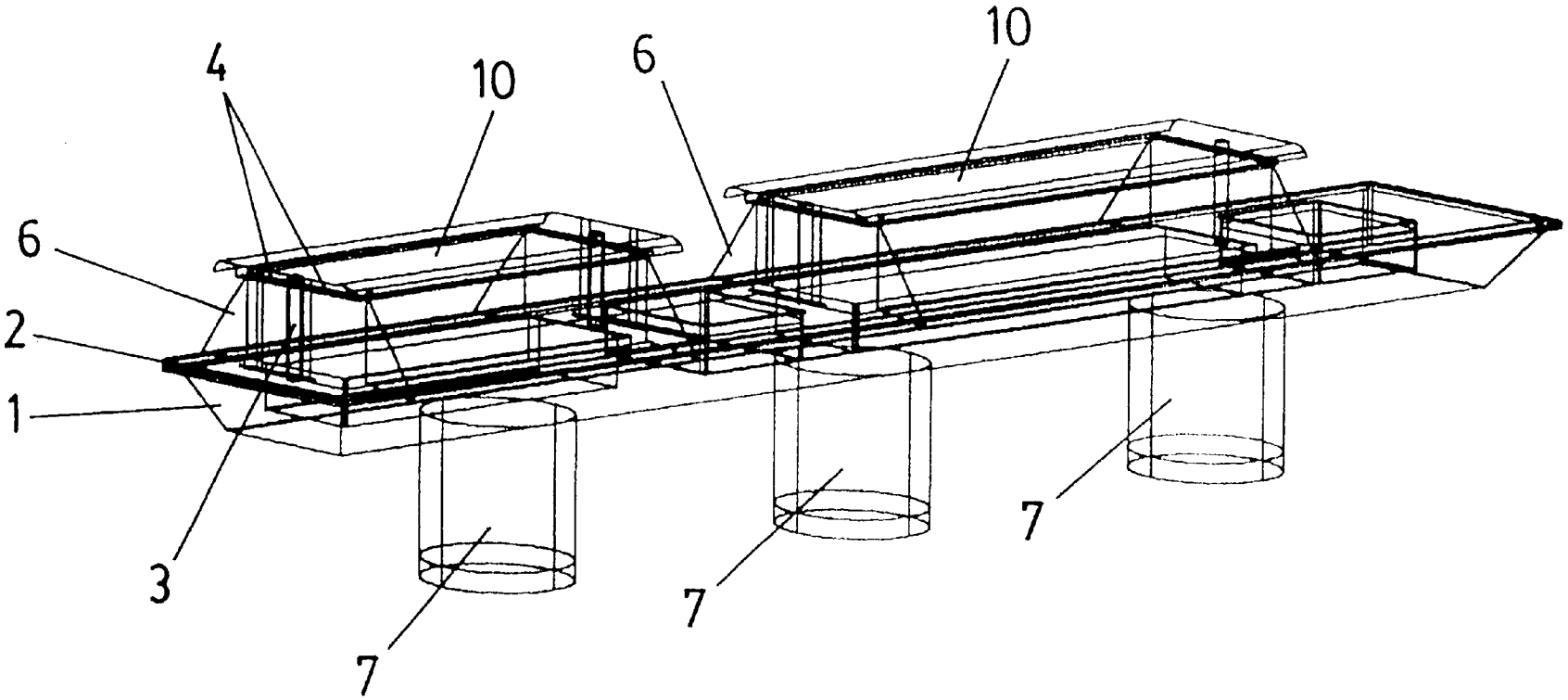
FIG. 2.—Shows a schematic view in perspective of an improved cabinet for displaying and conserving foodstuffs, implemented according to the present invention.

Here under is the be found a description of an example of the invention, with reference being made to the numbering adopted in the figures.

Thus, the improved cabinet for displaying and conserving foodstuffs of this example of embodiment has a main body 1 which takes the form of a counter with its corresponding top 2.

This top 2 is made of granite and on it the foodstuffs are set out in cold or hot trays of the foodstuffs as appropriate within the inner section that is shown as internal of the solid lines A, for which purpose the cabinet is equipped with adequate means for heating and cooling. There is also a horizontal outer section defined as the area between those solid lines A to the exterior edges 12 of the top 2 and which is used by the user to place a plate in transferring food from the foodstuffs located in the inner section.

From the central section of the top 2 a general collector 3 rises upwards and feeds into two horizontal arms 4 each of which terminates in adjustable baffles 5, so that said collector 3 transports an air current which is ejected to the outwards through the baffles 5, it being therefore possible to direct a continuous air curtain 6 towards different sections of the top 2 where the foodstuffs are located, the object being to prevent insects reaching these foodstuffs while not, however, impeding access by the users to said foodstuffs.

The air current that flows through the collector 3 is produced in a medium or high pressure blower 14 which can be mounted in the uprights 7 of the cabinet or located remotely at a certain distance from said cabinet. The flow produced by this blower is regulated by a regulator 16 that may be an electronic frequency control or regulated mechanically by means of valves. In any event, the continuous air curtain is directed toward the horizontal outer section and has a thickness or width corresponding to the width of the horizontal outer section and does not flow into the inner section.

The general collector 3 has a dust particle filter 8 in order that the air forming the curtains 6 is completely clean and cannot endanger the foodstuffs in question.

On the arms 4 a lighting panel 9 has been provided which permits the foodstuffs laid out on the top 2 to be illuminated.

Over this panel 9 is positioned a transparent shelf 10, made of glass or methacrylate, the edges of which are curved downwards in order to prevent the exhaled breath of those approaching the unit from reaching the foodstuffs displayed, and gives an excellent visual appearance to the cabinet of this example of implementation of the invention.

What is claimed is:

1. An improved cabinet for displaying and conserving foodstuffs, which permits self-service of foodstuffs by persons, the cabinet comprising:

a counter including an inner section and at least one substantially horizontal outer section, said inner section having a width sufficient for arranging said foodstuffs thereon, and said at least one horizontal outer section having a width sufficient for placing a plate thereon to transfer at least a portion of said foodstuffs from said inner section, a shelf having a height above said inner section, the shelf comprising air flow directing means for applying an insect-preventing continuous air curtain of an unrefrigerated flow of air directed downwards from said shelf towards the substantially horizontal outer section, the continuous air curtain having a thickness corresponding to said width of said outer section, when said air flow directing means impells the air curtain onto said outer section, wherein said air flow directing means directs said flow of air solely onto said outer section and not onto said inner section, so that said air curtain prevents insects from accessing said inner section without said air curtain contacting said foodstuffs and impeding access to said inner section by said persons.

2. The cabinet according to claim 1, wherein said width of said shelf is as large as said width of said inner area.

3. The cabinet according to claim 1, wherein it further comprises means for conserving the corresponding foodstuffs in at least one of a hot and cold state.

4. The cabinet according to claim 3, further comprising:

a general collector mounted in said counter and which extends to a predetermined height above said counter;

at least one arm communicating with an end of said general collector;

baffles communicating with said at least one arm for permitting changes in the direction of the corresponding air flow towards said counter;

wherein said air flow directing means comprises at least one blower unit, an outflow from said blower unit being collected in said general collector and flowing to said baffles via said at least one arm.

5. The cabinet according to claim 4, wherein said baffles are adjustable for directing and focusing the air curtain.

6. The cabinet according to claim 5, wherein said baffles are adjustable for concentrating and dispersing the air curtain.

7. The cabinet according to claim 6, wherein said blower is of medium or high pressure.

8. The cabinet according to claim 6, wherein said blower is housed in an upright portion of the cabinet.

9. The cabinet according to claim 6, wherein said blower is located remotely at a predetermined distance from the cabinet.

10. The cabinet according to claim 6, wherein said outflow from the blower is regulated by electronic frequency control.

11. The cabinet according to claim 6, wherein said flow from the blower is regulated mechanically by means of valves.

12. The cabinet according to claim 6, wherein said general collector includes a dust particle filter.

13. The cabinet according to claim 6, wherein said at least one arm terminates in said baffles and is arranged horizontally.

14. The cabinet according to claim 6, wherein said at least one arm terminates in said baffles and is mounted two in number.

15. The cabinet according to claim 6, further comprising a lighting panel housed on said at least one arm.

16. The cabinet according to claim 15, further comprising a shelf arranged on said lighting panel.

17. The cabinet according to claim 16, wherein said shelf has its edges curved and is transparent.

18. The cabinet according to claim 17, wherein said transparent shelf comprises one of glass or methacrylate.

* * * * *

UNITED STATES PATENT AND TRADEMARK OFFICE

CERTIFICATE OF CORRECTION

PATENT NO. : 6,367,274 B1
DATED : April 9, 2002
INVENTOR(S) : Antonio Criado Mellado It is certified that error appears in the above-identified patent and that said Letters Patent is hereby corrected as shown below:

Title page,
Item [76], The Inventor's Address on the Patent should be changed from "Technologico" to read -- Tecnologico --

Signed and Sealed this

Thirteenth Day of August, 2002

*Attest:*

*Attesting Officer*

JAMES E. ROGAN
*Director of the United States Patent and Trademark Office*